US010684582B2

(12) United States Patent
Fujihara

(10) Patent No.: US 10,684,582 B2
(45) Date of Patent: Jun. 16, 2020

(54) PRESSING MEMBER FOR FIXING, FIXING DEVICE, AND IMAGE FORMING APPARATUS

(71) Applicant: FUJI XEROX CO., LTD., Tokyo (JP)

(72) Inventor: Issei Fujihara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/269,010

(22) Filed: Feb. 6, 2019

(65) Prior Publication Data

US 2019/0294091 A1 Sep. 26, 2019

(30) Foreign Application Priority Data

Mar. 20, 2018 (JP) ..... 2018-052240

(51) Int. Cl.
*G03G 15/20* (2006.01)

(52) U.S. Cl.
CPC ..... *G03G 15/2064* (2013.01); *G03G 15/206* (2013.01)

(58) Field of Classification Search
CPC ..... G03G 15/2057; G03G 15/206; G03G 15/2064; B21B 27/00; B21B 27/02; F16C 13/00
See application file for complete search history.

(56) References Cited

U.S. PATENT DOCUMENTS

| | | | | |
|---|---|---|---|---|
| 6,096,395 | A * | 8/2000 | Hayashi | G03G 15/206 399/176 |
| 7,558,521 | B2 | 7/2009 | Ohhara et al. | |
| 2013/0251427 | A1* | 9/2013 | Fujihara | G03G 15/2053 399/333 |
| 2015/0110533 | A1* | 4/2015 | Kanematsu | G03G 15/2053 399/329 |
| 2018/0032004 | A1* | 2/2018 | Miyahara | G03G 15/206 |
| 2018/0217537 | A1* | 8/2018 | Abe | G03G 15/2057 |
| 2018/0373183 | A1* | 12/2018 | Murata | G03G 15/206 |

FOREIGN PATENT DOCUMENTS

| | | | | |
|---|---|---|---|---|
| JP | 02-282283 | A | 11/1990 | |
| JP | 06-274058 | A | 9/1994 | |
| JP | 09034300 | A * | 2/1997 | G03G 15/206 |
| JP | 2003-307961 | A | 10/2003 | |
| JP | 2008-40152 | A | 2/2008 | |
| JP | 2016-065972 | A | 4/2016 | |

OTHER PUBLICATIONS

Machine translation of JP 09-034300 A, publication date of Feb. 4, 1997, printed on Jul. 21, 2019.*

* cited by examiner

*Primary Examiner* — Sophia S Chen
(74) *Attorney, Agent, or Firm* — Sughrue Mion, PLLC

(57) ABSTRACT

A pressing member for fixing includes: an axial section; a cylindrical body that includes the axial section internally inserted, rotates following rotation of the axial section, and is extendable in an axial direction relative to the axial section; and an elastic layer that is stacked on an outer circumference of the cylindrical body.

16 Claims, 9 Drawing Sheets

PRESSING MEMBER FOR FIXING, FIXING DEVICE, AND IMAGE FORMING APPARATUS

CROSS-REFERENCE TO RELATED APPLICATIONS

This application is based on and claims priority under 35 USC 119 from Japanese Patent Application No. 2018-052240 filed Mar. 20, 2018.

BACKGROUND

(i) Technical Field

The present disclosure relates to a pressing member for fixing, a fixing device, and an image forming apparatus.

(ii) Related Art

Japanese Unexamined Patent Application Publication No. 2-282283 discloses a fixing-unit roller which includes a surface coating layer on a circumferential surface of core metal with a sponge layer interposed therebetween, and in which a great number of through bores or spiral through holes are provided in the sponge layer in parallel to the longitudinal direction of the core metal and in a circumferential direction of the core metal.

Japanese Unexamined Patent Application Publication No. 2003-307961 discloses a fixing-unit roller including a cylindrical core metal; a sponge layer formed on the outer circumferential surface of the core metal; and a surface coating layer formed on the outer circumferential surface of the sponge layer. In the fixing-unit roller, space communicating with a central portion of the core metal in the longitudinal direction and an end of the core metal in the longitudinal direction is formed between the core metal and the sponge layer.

Japanese Unexamined Patent Application Publication No. 2008-40152 discloses a roller including a cylindrical core metal; and a layer that covers the outer circumferential surface of the core metal with a predetermined thickness, includes air bubbles internally, and slit which penetrates the end faces of the layer through the air bubbles.

Japanese Unexamined Patent Application Publication No. 2016-65972 discloses a roller for a fixing device, including a cylindrical base material; at least one elastic layer provided on the circumferential surface of the base material; and multiple continuous holes provided in the longitudinal direction of the elastic layer. The cross sectional area of the continuous holes increases from the central portion of the elastic layer to an end in an axial direction.

SUMMARY

Aspects of non-limiting embodiments of the present disclosure relate to a pressing member for fixing, a fixing device, and an image forming apparatus Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

In a pressing member for fixing, including an axial section, and an elastic layer which is stacked layer on the outer circumference of the axial section, and the entire contact surface of the elastic layer with the axial section is fixed to the axial section, when the elastic layer thermally expands, the outer diameter of the pressing member for fixing may increase.

According to an aspect of the present disclosure, there is provided a pressing member for fixing, including: an axial section; a cylindrical body that includes the axial section internally inserted, rotates following rotation of the axial section, and is extendable in an axial direction relative to the axial section; and an elastic layer that is stacked on an outer circumference of the cylindrical body.

BRIEF DESCRIPTION OF THE DRAWINGS

Exemplary embodiments of the present disclosure will be described in detail based on the following figures, wherein.

DETAILED DESCRIPTION

Hereinafter, an example of an exemplary embodiment according to the present disclosure will be described with reference to the drawings.

(Image Forming Apparatus 10)

Figure 1:
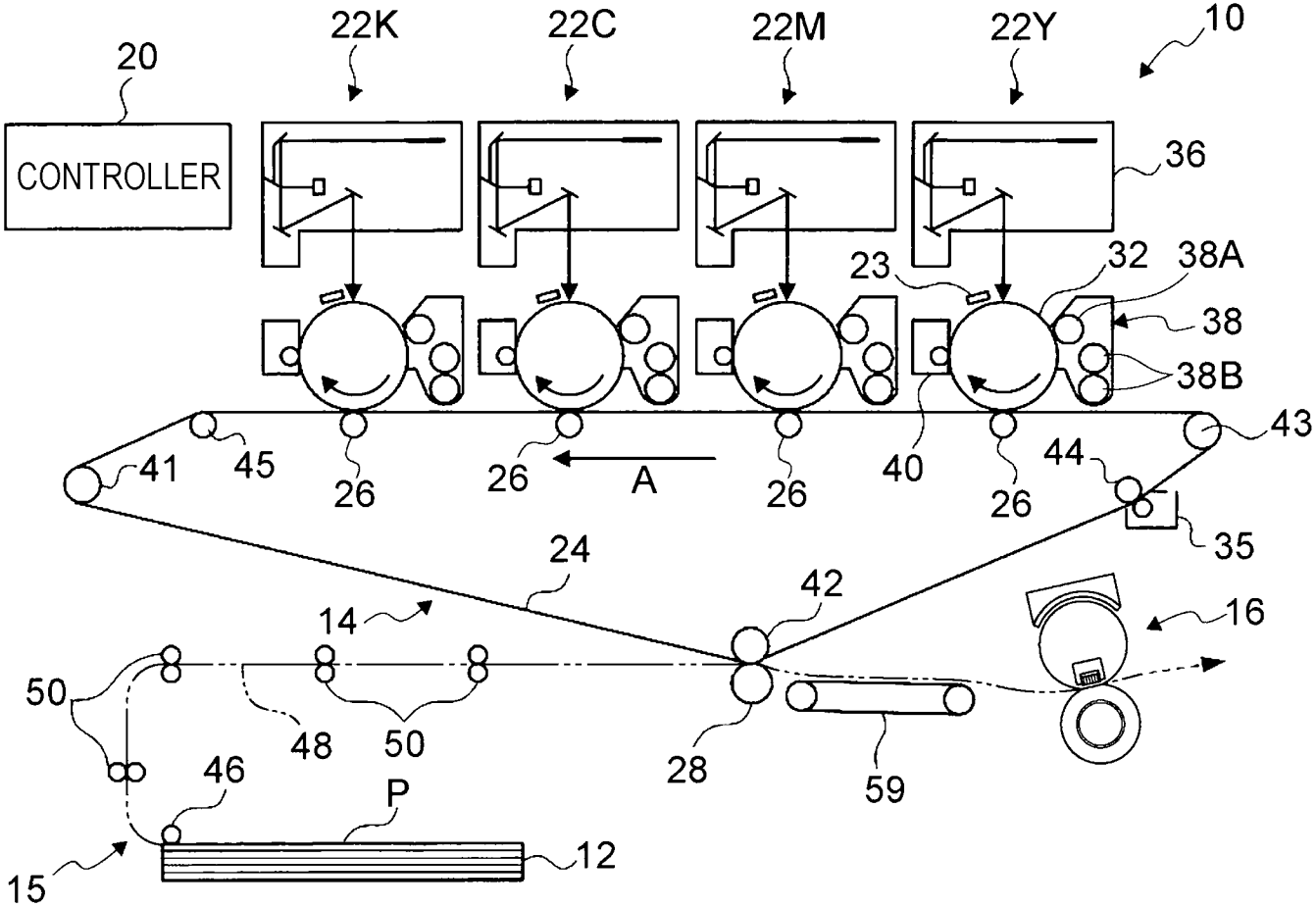
FIG. 1 is a schematic diagram illustrating the configuration of an image forming apparatus according to an exemplary embodiment.

The configuration of an image forming apparatus 10 according to the exemplary embodiment will be described. FIG. 1 is a schematic diagram illustrating the configuration of the image forming apparatus 10 according to the exemplary embodiment.

As illustrated in FIG. 1, the image forming apparatus 10 includes a storage unit 12 that stores a recording medium P such as paper, an image former 14 (an example of a former) that forms a toner image (an example of an image) on the recording medium P, and a transporter 15 that transports the recording medium P from the storage unit 12 to the image former 14.

In addition, the image forming apparatus 10 includes a fixing device 16 that fixes a toner image formed on the recording medium P onto the recording medium P; a transport member 59 (an example of a transport device) that transports the recording medium P with a toner image formed to the fixing device 16; and a controller 20 that controls the operation of each component of the image forming apparatus 10.

The image former 14 includes image forming units 22Y, 22M, 22C, and 22K (hereinafter indicated as 22Y to 22K) that form toner images of respective colors of yellow (Y), magenta (M), cyan (C), black (K); an intermediate transfer belt 24 onto which the toner images formed by the image forming units 22Y to 22K are transferred; first transfer rollers 26 that transfer the toner images formed by the image forming units 22Y to 22K to the intermediate transfer belt 24; and a second transfer roller 28 that transfers the toner images from the intermediate transfer belt 24 to the recording medium P, the toner images being transferred onto the intermediate transfer belt 24 by the first transfer rollers 26. The configuration of the image former 14 is not limited to the above-described configuration, and may be another configuration, it is sufficient that the image former 14 form an image on the recording medium P.

The image forming units 22Y to 22K are arranged on the upper side of the intermediate transfer belt 24 in a horizontal direction. The image forming units 22Y to 22K have respective photoconductors 32 that rotate in one direction (for instance, the clockwise direction in FIG. 1). Since the image forming units 22Y to 22K are configured in the same manner, the image forming unit 22Y represents the image forming units 22Y to 22K, and each of the components of the image forming unit 22Y is labeled with a symbol in FIG. 1.

In the surroundings of each of the photoconductors 32, there are provided a charging device 23 that charges the photoconductor 32; an exposure device 36 that exposes the photoconductor 32 charged by the charging device 23 to light, and forms an electrostatic latent image on the photoconductor 32; a developing device 38 that develops the electrostatic latent image formed on the photoconductor 32 by the exposure device 36 to form a toner image; and a removal device 40 that comes into contact with the photoconductor 32 to remove residual toner on the photoconductor 32 in that order from the upstream side of the photoconductor 32 in the rotational direction.

The exposure device 36 forms an electrostatic latent image based on the image signal sent from the controller 20. The image signal sent from the controller 20 is, for instance, an image signal obtained by the controller 20 from an external device.

The developing device 38 includes a developer supply unit 38A that supplies developer to the photoconductor 32, and multiple transport members 38B that transport the developer supplied to the developer supply unit 38A while agitating the developer.

The intermediate transfer belt 24 is formed in an oval shape, and disposed on the lower side of the image forming units 22Y to 22K. On the inner circumferential side of the intermediate transfer belt 24, there are provided winding rollers 41, 42, 43, 44, and 45, around of which the intermediate transfer belt 24 wound. As an example, the winding roller 43 is rotationally driven, and the intermediate transfer belt 24 is thereby moved (rotated) circularly in one direction (for instance, in a direction of A in FIG. 1) while being in contact with the photoconductors 32. The winding roller 42 is an opposite roller that is opposed to the second transfer roller 28. At a position opposed to the winding roller 44 with the intermediate transfer belt 24 interposed therebetween, there is provided a removal device 35 that removes residual toner on the intermediate transfer belt 24.

Each of the first transfer rollers 26 is opposed to a photoconductor 32 with the intermediate transfer belt 24 interposed therebetween. A first transfer position is defined as between the first transfer roller 26 and the photoconductor 32 where a toner image formed on the photoconductor 32 is transferred to the intermediate transfer belt 24.

The second transfer roller 28 is opposed to the winding roller 42 with the intermediate transfer belt 24 interposed therebetween. A second transfer position is defined as between the second transfer roller 28 and the winding rollers 42 where a toner image transferred to the intermediate transfer belt 24 is transferred onto the recording medium P. The second transfer roller 28 transfers the toner image of the intermediate transfer belt 24 onto the recording medium P at the second transfer position, thereby forming a toner image on the recording medium P.

The transporter 15 includes a delivery roller 46 that delivers the recording medium P stored in the storage unit 12; a transport path 48 along which the recording medium P delivered by the delivery roller 46 is transported; and multiple transport rollers 50 that are disposed along the transport path 48, and transport the recording medium P delivered by the delivery roller 46 to the second transfer position.

The transport member 59 is disposed on the downstream side of the second transfer position in the transport direction. The transport member 59 transports the recording medium P on which a toner image has been transferred by the second transfer roller 28. Specifically, the transport member 59 has an oval (endless shaped) transport belt, and a pair of rollers around which the transport belt is wound. At least one of the pair of rollers is rotationally driven with the recording medium P held on the outer circumferential surface by the transport belt, and the recording medium P is thereby transported to the fixing device 16. Specifically, the transport member 59 transports the recording medium P to a contact area 67 of between the later-described heat fixing belt 70 and pressure roller 60 in the fixing device 16. As an example, the transport belt holds the recording medium P which is attracted through multiple air inlets formed in the transport belt.

The fixing device 16 is disposed on the downstream side of the transport member 59 in the transport direction. The fixing device 16 fixes a toner image onto the recording medium P, the toner image being transferred by the second transfer roller 28 onto the recording medium P. The specific configuration of the fixing device 16 will be described later.

(Image Forming Operation)

Next, the image forming operation to form an image on the recording medium P in the image forming apparatus 10 according to the exemplary embodiment will be described.

In the image forming apparatus 10 according to the exemplary embodiment, the recording medium P delivered from the storage 12 by the delivery roller 46 is sent to the second transfer position by multiple transport rollers 50.

Meanwhile, in each of the image forming units 22Y to 22K, the photoconductor 32 charged by the charging device 23 is exposed to light by the exposure device 36, and an electrostatic latent image is thereby formed in the photoconductor 32. The electrostatic latent image is developed by the developing device 38, and a toner image is formed on the photoconductor 32. The toner images of respective colors formed by the image forming units 22Y to 22K are superimposed on the intermediate transfer belt 24 at respective first transfer positions, thereby forming a color image. The color image formed on the intermediate transfer belt 24 is transferred to the recording medium P at the second transfer position.

The recording medium P with the toner image transferred is transported to the fixing device 16 by the transport member 59, and the transferred toner image is fixed by the fixing device 16. As described above, a series of image forming operations are performed.

(Fixing Device 16)

Figure 2:
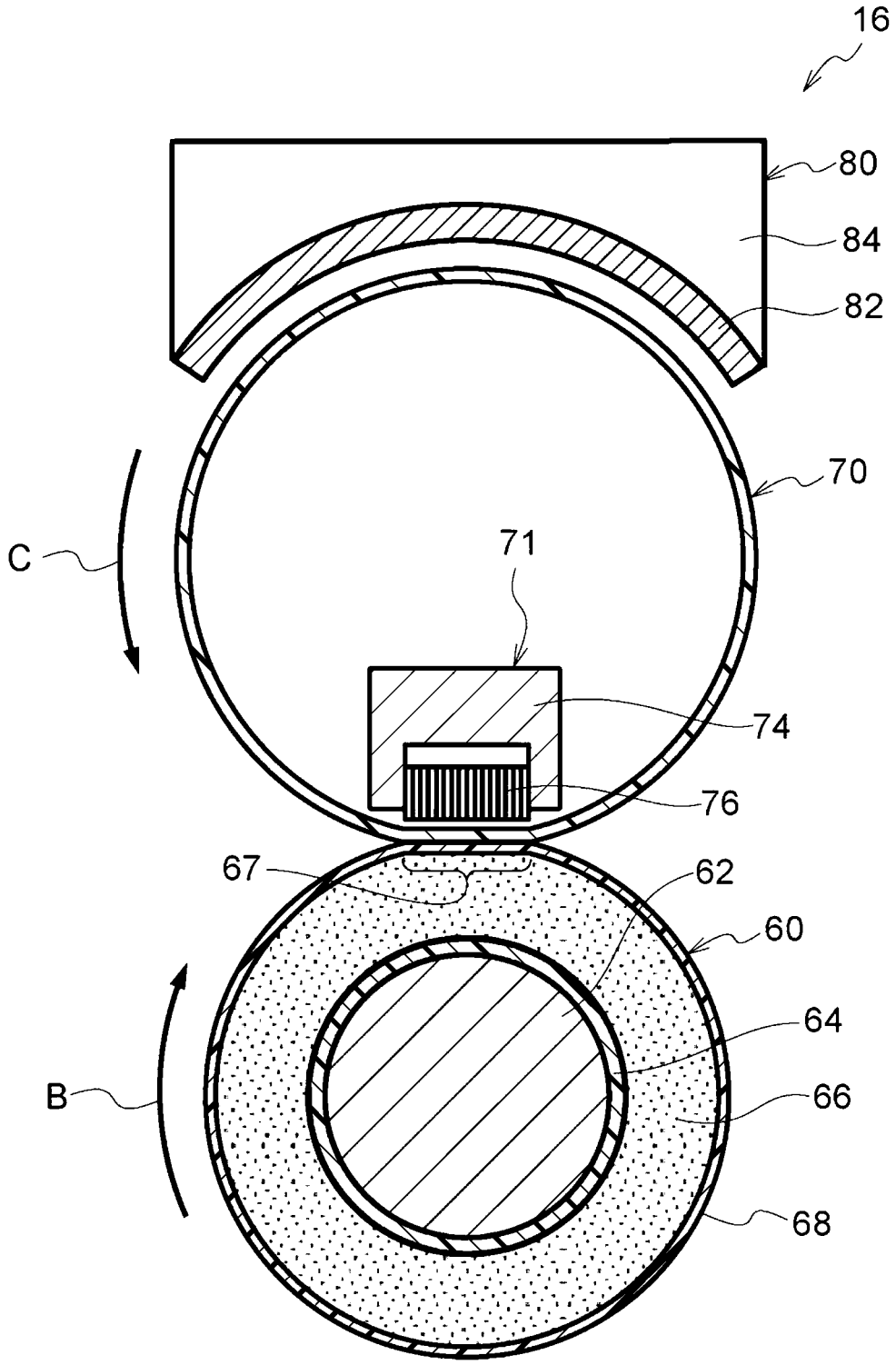
FIG. 2 is a cross-sectional view illustrating the configuration of the fixing device illustrated in FIG. 1.
Figure 3:
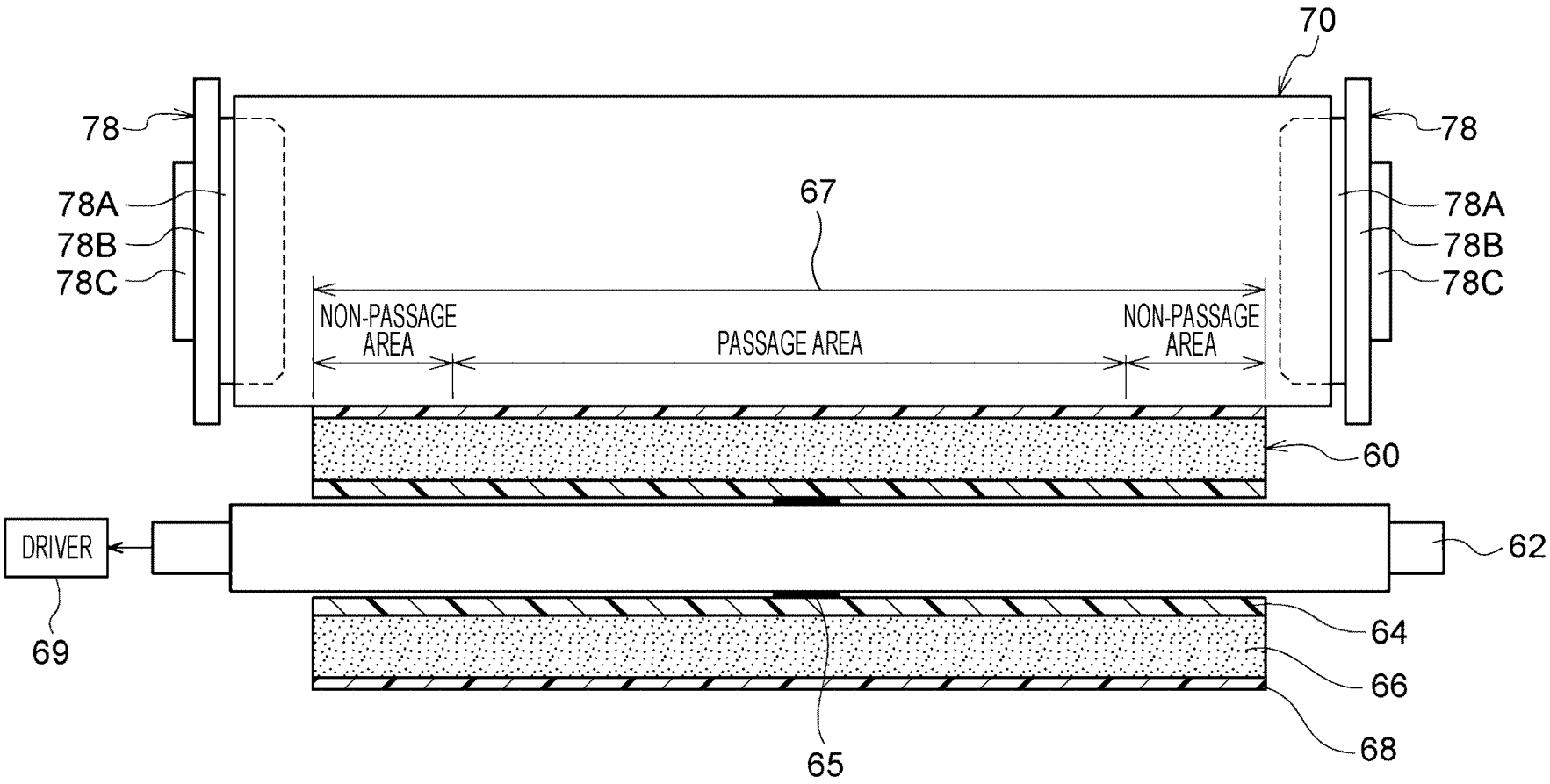
FIG. 3 is a partial cross-sectional view of the fixing device illustrated in FIG. 1 as seen in a direction in which a recording medium is transported.

Next, the configuration of the fixing device 16 according to the exemplary embodiment will be described. FIG. 2 is a cross-sectional view illustrating the configuration of the fixing device 16 illustrated in FIG. 1. FIG. 3 is a partial cross-sectional view of the fixing device 16 as seen in the direction in which the recording medium P is transported.

The fixing device 16 illustrated in FIGS. 2 and 3 is an example of a fixing device that fixes an image onto a recording medium. Specifically, the fixing device 16 heats and pressurizes a toner image transferred onto the recording medium P to fix the toner image onto the recording medium P. More specifically, the fixing device 16 is an electromagnetic induction-heating fixing device. More specifically, as illustrated in FIG. 2, the fixing device 16 includes a pressure roller 60, a magnetic field generator 80, a heat fixing belt 70, and a pressure member 71.

Hereinafter, the specific configuration of the components (the pressure roller 60, the magnetic field generator 80, the heat fixing belt 70, and the pressure member 71) of the fixing device 16 will be described.

(Pressure Roller 60)

The pressure roller 60 illustrated in FIGS. 2 and 3 is an example of a pressing member for fixing, including an axial section, a cylindrical body, and an elastic layer. Specifically, the pressure roller 60 pressurizes the recording medium P between the heat fixing belt 70 and the pressure roller 60. More specifically, as illustrated in FIGS. 2 and 3, the pressure roller 60 includes core metal 62 (an example of the axial section), a cylindrical sleeve 64 (an example of the cylindrical body), an elastic layer 66 (an example of the elastic layer), and a release layer 68. Hereinafter, the specific configuration of the components (the core metal 62, the cylindrical sleeve 64, the elastic layer 66, and the release layer 68) of the pressure roller 60 will be described.

(Core Metal 62)

The core metal 62 illustrated in FIGS. 2 and 3 is an example of the axial section. Specifically, the core metal 62 is formed in a cylindrical body or a cylindrical column body. More specifically, the core metal 62 is configurated in the following manner.

The core metal 62 is formed in a circular tube body made of metal material, such as aluminum, stainless steel (SUS), sulfur and sulfur composite free-cutting steel materials (SUM), and iron.

The outer diameter of the core metal 62 is, for instance, 10 mm or higher and 100 mm or lower. The thickness of the core metal 62 is 5 mm or higher for instance when the core metal 62 is made of aluminum, and is 3 mm or higher when the core metal 62 is made of SUS, SUM, or iron. For instance, a nickel-plated cylindrical body having an outer diameter of 16 mm and a thickness of 3 mm is used as the core metal 62 of the exemplary embodiment. The linear expansion coefficient of the core metal 62 in the axial direction is for instance, $1.1\times10^{-5}$/K.

Both ends of the core metal 62 in the axial direction are rotatably supported by respective bearings (not illustrated). The bearings (not illustrated) that support the both axial ends of the core metal 62 are pressed or pulled toward the heat fixing belt 70 (the upper side in FIGS. 2 and 3) by an elastic member (not illustrated) such as a spring. In other words, a force toward the heat fixing belt 70 (the upper side in FIGS. 2 and 3) is applied to the both axial ends of the core metal 62. A driving force is given to the core metal 62 via an axial one end thereof from a driver 69 (see FIG. 3), and the core metal 62 is rotationally driven. Thus, the pressure roller 60 is rotated in the direction of an arrow B in FIG. 2.

(Cylindrical Sleeve 64)

The cylindrical sleeve 64 illustrated in FIGS. 2 and 3 is an example of a cylindrical body that includes the axial section internally inserted, rotates following the rotation of the axial section, and is expandable relative to the axial section in the axial direction. Specifically, the cylindrical sleeve 64 is a cylindrical body that includes the core metal 62 internally inserted, rotates following the rotation of the core metal 62, and is expandable relative to the core metal 62 in the axial direction.

The cylindrical sleeve 64 is also an example of a cylindrical body which includes the axial section internally inserted, and in which part of the cylindrical sleeve 64 in the axial direction is constrained to the axial section, and a portion from the part to an end in the axial direction is not constrained to the axial section. Specifically, the cylindrical sleeve 64 is a cylindrical body which includes the core metal 62 internally inserted, and in which part of the cylindrical sleeve 64 in the axial direction is constrained to the core metal 62, and a portion from the part to an end in the axial direction is not constrained to the core metal 62. More specifically, the cylindrical sleeve 64 is configurated in the following manner.

In the cylindrical sleeve 64, a central portion thereof in the axial direction (hereinafter simply referred to as a central portion) is constrained to the core metal 62. Specifically, a central portion of the cylindrical sleeve 64 is fixed to the core metal 62 by a fixing material 65 such as an adhesive.

In this manner, the cylindrical sleeve 64 is fixed to the core metal 62, thus is configured to rotate integrally with the core metal 62. In other words, the cylindrical sleeve 64 has a function of rotating following the rotation of the core metal 62. The elastic layer 66 stacked on the outer circumference of the cylindrical sleeve 64, and the release layer 68 stacked on the outer circumference of the elastic layer 66 also rotate integrally with the cylindrical sleeve 64.

In the cylindrical sleeve 64, both end-side portions of the central portion in the axial direction are not constrained to the core metal 62. In other words, in the cylindrical sleeve 64, the portions (hereinafter referred to as non-constraint portions) other than the central portion constrained to the core metal 62 are not constrained to the core metal 62. In other words, the non-constraint portions of the cylindrical sleeve 64 are not fixed to the core metal 62.

When the cylindrical sleeve 64 thermally expands, the cylindrical sleeve 64 extends in the axial direction relative to the core metal 62 because the non-constraint portions are not constrained to the core metal 62. In this manner, in the cylindrical sleeve 64, the non-constraint portions have a function of expanding in the axial direction relative to the core metal 62. In other words, in the cylindrical sleeve 64, the non-constraint portions are allowed to expand independently of the core metal 62.

The linear expansion coefficient of the cylindrical sleeve 64 in the axial direction is set to be higher than the linear expansion coefficient of the core metal 62 in the axial direction. Specifically, the linear expansion coefficient of the cylindrical sleeve 64 in the axial direction is preferably $3\times10^{5}$/K or higher. In addition, the linear expansion coefficient of the cylindrical sleeve 64 in the axial direction is more preferably $5\times10^{-5}$/K or higher.

The linear expansion coefficient of the cylindrical sleeve 64 in the axial direction is preferably $2\times10^{-4}$/K or lower. This is because when the linear expansion coefficient of the cylindrical sleeve 64 in the axial direction is higher than $2\times10^{4}$/K, the projection length of the axial ends of the cylindrical sleeve 64 becomes too long because of extension due to thermal expansion in the axial direction, and the axial ends of the cylindrical sleeve 64 are likely to come into contact with the arrangement members (for instance, the bearings and the core metal 62 and an end regulating member 78) arranged outwardly in the axial direction. In other words, the linear expansion coefficient of the cylindrical sleeve 64 in the axial direction is such that when the cylindrical sleeve 64 thermally expands, the linear expansion coefficient of the axial ends of the cylindrical sleeve 64 is lower than a linear expansion coefficient which causes the axial ends to come into contact with the above-described arrangement members.

In the exemplary embodiment, the linear expansion coefficient of the cylindrical sleeve 64 in the axial direction is, for instance, $1.2\times10^{-4}$/K.

In addition, the cylindrical sleeve 64 has an anisotropic linear expansion coefficient. Specifically, the linear expansion coefficient of the cylindrical sleeve 64 in a circumferential direction is lower than the linear expansion coefficient of the cylindrical sleeve 64 in the axial direction. In addition, the linear expansion coefficient of the cylindrical sleeve 64 in the circumferential direction is lower than the linear expansion coefficient of the core metal 62 in the axial direction.

In the exemplary embodiment, the linear expansion coefficient of the cylindrical sleeve 64 in the circumferential direction is, for instance, $4.0\times10^{-6}$/K.

The inner diameter of the cylindrical sleeve 64 is the same as the outer diameter of the core metal 62. Specifically, the cylindrical sleeve 64 is lightly in contact with the outer circumferential surface of the core metal 62, which is inserted inside the cylindrical sleeve 64, to allow extension of the cylindrical sleeve 64 in the axial direction due to thermal expansion.

The inner diameter of the cylindrical sleeve 64 may be smaller than the outer diameter of the core metal 62. Specifically, the cylindrical sleeve 64 may have a gap between the cylindrical sleeve 64 and the outer circumferential surface of the internally inserted core metal 62. In other words, the cylindrical sleeve 64 has an inner diameter which allows extension of the cylindrical sleeve 64 in the axial direction due to thermal expansion.

The thickness of the cylindrical sleeve 64 is 2 mm or less, for instance. When the thickness of the cylindrical sleeve 64 is 2 mm or less, thermal expansion of the cylindrical sleeve 64 outwardly in the radial direction is maintained to be small. The thickness of the cylindrical sleeve 64 is 0.5 mm or greater, for instance. This is because when the thickness of the cylindrical sleeve 64 is less than 0.5 mm, when the core metal 62 is rotationally driven, the cylindrical sleeve 64 may deform and break depending on the strength of the material of the cylindrical sleeve 64, and the elastic layer 66 may be unable to rotate. In other words, the thickness of the cylindrical sleeve 64 is made smaller within a range ensuring the strength (durability) to allow the elastic layer 66 to rotate.

In the exemplary embodiment, for instance, the inner diameter of the cylindrical sleeve 64 is 16 mm, and the outer diameter of the cylindrical sleeve 64 is 18 mm.

The cylindrical sleeve 64 is made of heat-resistant resin material. Specifically, for instance, a compound containing a heat-resistant resin material and a filling material is used for the cylindrical sleeve 64. The following may be used as the heat-resistant resin material includes: poly phenyl sulfone (PPSU), polysulfone (PSU), polyarylate (PAR), polyetherimide (PEI), polyether ether ketone (PEEK), polyphenylenesulfide (PPS), polyethersulfone (PES), polyamide-imide (PAI), liquid crystal polymer (LCP), polyimide (PI), polytetrafluoroethylene (PTFE), polychloro-trifluoroethylene (PCTFE), polyvinylidene fluoride (PVDF), tetrafluoroethylene-perfluoroalkyl vinyl ether copolymer (PFA), tetrafluoroethylene hexafluoropropylene copolymer (FEP), epoxy resin, silicon resin, silicone rubber with high hardness, and fluoride rubber. For instance, glass fiber, carbon fiber, graphite, carbon nanotube (CNT), and other various inorganic fillers may be used as the filling material.

The material used for the cylindrical sleeve 64 is not limited to the above-mentioned materials, and various materials may be used as long as the above-mentioned ranges and durability of linear expansion coefficient are met.

The following method is used as a method of molding the cylindrical sleeve 64. When the cylindrical sleeve 64 having no anisotropic linear expansion coefficient is molded, the cylindrical sleeve 64 may be molded by general injection molding, compression molding, and flow coating to a cylindrical mold.

For a material in which the filling material has high orientation, and anisotropy of the linear expansion coefficient occurs injection molding, molding is possible by performing, for instance, injection molding in a spiral pattern so that the linear expansion coefficient in the axial direction is higher than the linear expansion coefficient in the circumferential direction, then space is connected using an adhesive material or by welding, and a cylindrical body is formed.

The cylindrical sleeve 64 includes the internally inserted core metal 62, and as described later, the elastic layer 66 is stacked on the outer circumferential surface of the cylindrical sleeve 64. Thus, the cylindrical sleeve 64 may be considered as a member which is inserted between the core metal 62 and the elastic layers 66. In the exemplary embodiment, the cylindrical sleeve 64 is formed of one component.

(Elastic Layer 66)

The elastic layer 66 illustrated in FIGS. 2 and 3 is an example of an elastic layer stacked on the outer circumference of the cylindrical body. Specifically, the elastic layer 66 is fixed to the outer circumferential surface of the cylindrical sleeve 64 with the elastic layer 66 stacked on the outer circumference of the cylindrical sleeve 64. More specifically, the elastic layer 66 is configurated in the following manner.

The elastic layer 66 is made of foam such as silicone rubber, fluoro rubber, fluorosilicone rubber, for instance. For instance, azobis-isobutyronitrile (AIBN), sodium hydrogen carbonate, ammonium carbonate, and diazoaminobenzene are used as the foam.

In addition to forming heated form by adding various foaming agents to unvulcanized rubber such as silicone rubber, it is possible to use self-foaming reaction foamed rubber, such as two component liquid silicone rubber, which generates crosslinking reaction gas.

A great number of air bubbles are distributed in the elastic layer 66, and the inside of each air bubble is filled with a gas such as air. It is preferable that the expansion rate of the elastic layer 66 be 120% or higher and 250% or lower.

The air bubbles of the elastic layer 66 preferably have a continuous foam structure in which the air bubbles are likely to be released when the elastic layer 66 thermally expands internally at the time of heating.

The elastic layer 66 may be formed by distributing hollow particles, such as glass balloons and resin balloons, in liquid silicone rubber. Since the glass balloons and resin balloons are hollow internally, they are unlikely to thermally expand, and thus the elastic layer 66 is unlikely to thermally expand due to inclusion of the hollow particles. The median size of the hollow particles included in the elastic layer 66 after molding is in a range of 1μ to 500 μm, for instance. The percentage of content of the hollow particles after molding is in a range of 5 vol % to 60 vol %, for instance.

The elastic layer 66 is formed so as to cover the entire outer circumferential surface of the cylindrical sleeve 64, and the thickness of the elastic layer 66 is preferably 2 mm to 20 mm, and more preferably 3 mm to 10 mm.

The linear expansion coefficient of the elastic layer 66 is higher than the linear expansion coefficient of the cylindrical sleeve 64 in the axial direction. The linear expansion coefficient of the elastic layer 66 is, for instance, $2.5\times10^{-4}$/K.

In the exemplary embodiment, the elastic layer 66 is formed as a 5 mm thick layer with foam of silicone rubber, is adjusted so that the hardness is 60° (Asker-C). The elastic layer 66 is fixed to the outer circumferential surface of the cylindrical sleeve 64 by a fixing material such as an adhesive, for instance.

In the elastic layer 66, no through hole (see FIG. 6) is formed which penetrates the pressure roller 60 in the axial direction.

(Release Layer 68)

The release layer 68 illustrated in FIGS. 2 and 3 is stacked on the outer circumference of the elastic layer 66. Specifically, the release layer 68 is fixed to the outer circumferential surface of the elastic layer 66 with the release layer 68 stacked on the outer circumference of the elastic layer 66.

The release layer 68 is made of a material with high releasing property and heat resistance, such as fluorine resin, silicon resin, silicone rubber, fluoro rubber, fluorinated polyimide, such as PFA, PTFE, FEP.

The release layer 68 is formed so as to cover the entire outer circumferential surface of the elastic layer 66, and the thickness of the release layer 68 is preferably 10 μm to 200 μm, and more preferably 20 μm to 100 μm.

The linear expansion coefficient of the release layer 68 is higher than the linear expansion coefficient of the elastic layer 66. The release layer 68 has more flexibility than the elastic layer 66. For this reason, thermal expansion (extension) of the elastic layer 66 in the axial direction is allowed.

In the exemplary embodiment, the release layer 68 is formed as a 30 μm thick layer with PFA, for instance.

(Magnetic Field Generator 80)

The magnetic field generator 80 illustrated in FIG. 2 generates an alternating magnetic flux for heating the later-described heat generation layer of the heat fixing belt 70. The magnetic field generator 80 includes a magnetic core (not illustrated), a magnetizing coil 82, and a magnetizing coil holding member 84.

The magnetic core (not illustrated) is made of a material with high magnetic permeability, such as ferrite and Permalloy. The magnetizing coil 82 generates an alternating magnetic flux with the alternating current supplied from a magnetizing circuit (not illustrated). The magnetizing coil 82 is formed by winding multiple bundles of wires, each bundle formed by bundling multiple copper wires each covered by an insulating material, for instance. The magnetizing coil holding member 84 holds the magnetizing coil 82 with multiple bundles of wires wound.

The magnetic core (not illustrated) and the magnetizing coil 82 are formed along the outer circumferential surface of the heat fixing belt 70 which is held in a cylindrical shape. In the exemplary embodiment, the distance between the outer surface of the heat fixing belt 70 and the magnetizing coil 82 is set to 2 mm.

(Pressure Member 71)

The pressure member 71 illustrated in FIG. 2 is formed by mounting a pressure pad 76 made of silicone rubber on a holder 74 which serves as a retainer. In the exemplary embodiment, the hardness of the pressure pad 76 is 20° (JIS-A). The holder 74 is made of metal such as stainless steel or a synthetic resin with high heat resistance.

(Heat Fixing Belt 70)

The heat fixing belt 70 illustrated in FIGS. 2 and 3 is an example of a fixing member that forms a contact area between the pressing member for fixing and the heat fixing belt 70 by being heated by a heating device, and pressed by a pressing member for fixing, transports a recording medium inserted in the contact area, and heats and pressurizes an image to fix the image onto the recording medium.

Specifically, the heat fixing belt 70 is a fixing member that forms the contact area 67 between the pressure roller 60 and the heat fixing belt 70 by being heated by the magnetic field generator 80, and pressed by the pressure roller 60, transports the recording medium P inserted in the contact area 67, and heats and pressurizes an image to fix the image onto the recording medium P. More specifically, the heat fixing belt 70 is configurated in the following manner.

As illustrated in FIG. 2, the heat fixing belt 70 is an oval belt and has a layer structure in which a base material layer, a heat generation layer, an elastic layer, and a release layer are stacked in that order from the inner surface side.

The base material layer is made of high heat resistant resin having a thickness of 10 μm to 100 μm, for instance. For instance polyester, polyethylene terephthalate, polyethersulfone, polyether ketone, polysulfone, polyimide, polyimide-amide, polyamide may be used as the resin. In the exemplary embodiment, polyimide having a thickness of 50 μm is used.

A metal layer, such as an iron, cobalt, nickel, copper, or chromium layer, formed with a thickness of 1 μm to 50 μm, for instance, is used as the heat generation layer. It is desirable that the thickness of the heat generation layer be small as much as possible so that the heat fixing belt 70 is deformed to conform with the shape of the pressure member 71. In the exemplary embodiment, highly conductive copper plated on the base material layer with a thickness of 10 μm is used as the heat generation layer to increase the heat generation efficiency.

The elastic layer is made of silicone rubber, a fluoro rubber, or fluorosilicone rubber which has high heat resistance and high thermal conductivity. The thickness of the elastic layer is preferably 10 μm to 500 μm, and more preferably 50 μm to 500 μm. In the exemplary embodiment, the thickness of the elastic layer is 300 μm.

The hardness of the elastic layer is preferably 60° (JIS-A: JIS-KA type testing machine) or less, and more preferably 45° or less.

The release layer 68 is preferably made of a material with high releasing property and heat resistance, such as fluorine resin, silicon resin, silicone rubber, fluoro rubber, such as PFA, PTFE, FEP. The thickness of the release layer is preferably 20 μm to 100 μm, and in the exemplary embodiment, the thickness of the release layer is 30 μm.

As illustrated in FIG. 3, each of both ends of the heat fixing belt 70 is provided with the end regulating member 78. The end regulating member 78 has a cylindrical section 78A, a flange 78B, and a retainer 78C. The cylindrical section 78A has an outer diameter smaller than the inner diameter when the heat fixing belt 70 is held in a cylindrical shape. The cylindrical section 78A is inserted in each end of the heat fixing belt 70. The flange 78B has an outer diameter larger than the outer diameter of the heat fixing belt 70 held in the cylindrical section 78A. The both ends of the heat fixing belt 70 are pressed against respective flanges 78B, thereby reducing meandering of the heat fixing belt 70. The retainer 78C is provided at the outside of the flange 78B. The retainer 78C is fixed to the housing (not illustrated) of the fixing device 16.

As illustrated in FIG. 2, the heat fixing belt 70 is interposed between the lower surface of the pressure member 71 and the outer circumferential surface of the pressure roller 60. Specifically, a force toward the heat fixing belt 70 (the upper side in FIG. 2) is applied to both ends of the core metal 62 of the pressure roller 60 in the axial direction, and the pressure roller 60 is thereby pressed against the heat fixing belt 70. Consequently, the contact area 67 is formed between the heat fixing belt 70 and the pressure roller 60. The elastic layer 66 and the release layer 68 of the pressure roller 60 are elastically deformed, and thus the contact area 67 having a specific width in the circumferential direction of the pressure roller 60 is formed.

The pressure roller 60 is rotated by the driver 69 in the direction of an arrow B of FIG. 2, and a frictional force is thereby applied to the outer circumferential surface of the heat fixing belt 70, and the heat fixing belt 70 is driven to rotate in the direction of an arrow C while the lower surface of the pressure member 71 is being rubbed on the inner circumferential surface of the heat fixing belt 70. Consequently, the heat fixing belt 70 transports the recording medium P inserted in the contact area 67 between the pressure roller 60 and the heat fixing belt 70. Heat generated in the heat generation layer of the heat fixing belt 70 is transmitted to a toner image formed on the transported recording medium P in the contact area 67 via the elastic layer and the release layer of the heat fixing belt 70. In this manner, the toner image is heated as well as pressurized in the contact area 67, and the recording medium P is thereby fixed to the toner image.

The width of the contact area 67 in the axial direction of the pressure roller 60 is larger than the width of the recording medium P (the maximum width of a transportable recording medium). The recording medium P is transported through the contact area 67 with the center of the recording medium P in the width direction matched to the center of the contact area 67 in the width direction in a predetermined acceptable range.

Thus, as illustrated in FIG. 3, the contact area 67 has a passage area through which the recording medium P passes on the central side of the pressure roller 60 in the width direction (the axial direction of the pressure roller 60), and a non-passage area through which the recording medium P does not pass on both-end sides of the passage area in the width direction.

(Operation of Fixing Device 16)

In the fixing device 16, the heat fixing belt 70 and the pressure roller 60 transport the recording medium P inserted in the contact area 67. In the contact area 67, the heat fixing belt 70 heats a toner image as well as the heat fixing belt 70 and the pressure roller 60 pressurize the toner image and the recording medium P, thereby fixing the toner image onto the recording medium P. In the fixing device 16, the heat of the heat fixing belt 70, which heats a toner image, is transmitted to the pressure roller 60, and the pressure roller 60 thermally expands. The pressure roller 60 is heated in the order of components from the outside by the heat of the heat fixing belt 70. Specifically, the pressure roller 60 is heated in the order of the release layer 68, the elastic layer 66, the cylindrical sleeve 64, and the core metal 62.

Figure 4:
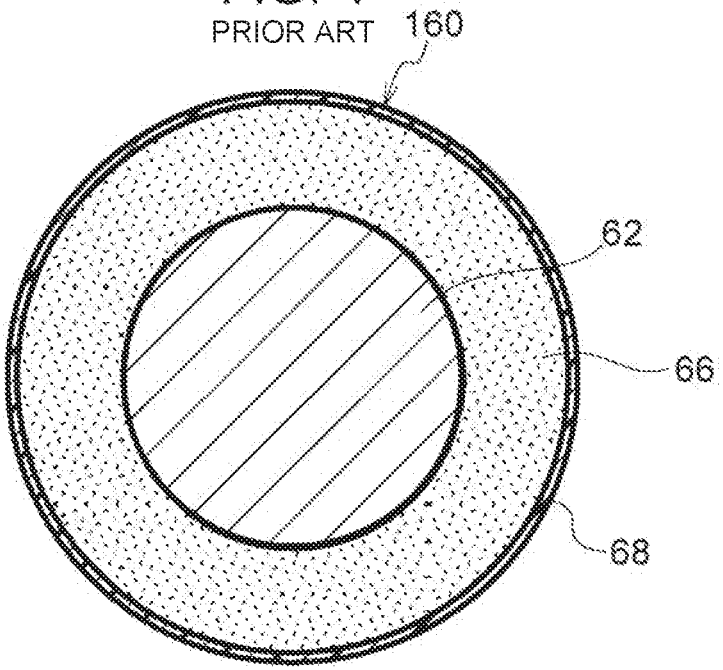
FIG. 4 PRIOR ART
FIG. 4 is a cross-sectional view of a pressure roller according to a first comparative example.

As illustrated in FIG. 4, in the case where the pressure roller 160 (first comparative example) is used in which the elastic layer 66 is directly stacked on the outer circumference of the core metal 62, and the entire contact surface of the elastic layer 66 with the core metal 62 is fixed to the core metal 62, when the heat of the heat fixing belt 70 is transmitted to the pressure roller 160, the pressure roller 160 thermally expands in the following manner. Specifically, in the pressure roller 160, the elastic layer 66 of the pressure roller 160 primarily thermally expands. Since the entire contact surface of the elastic layer 66 with the core metal 62 is fixed to the core metal 62 in the elastic layer 66, the elastic layer 66 is unlikely to expand (extend) in the axial direction of the core metal 62 relative to the core metal 62, but expands outwardly in the radial direction of the core metal 62. Therefore, the outer diameter of the pressure roller 160 increases. When the outer diameter of the pressure roller 160 increases, the peripheral length of the pressure roller 60 changes, and the transport speed may vary when the heat fixing belt 70 and the pressure roller 160 transport the recording medium P inserted in the contact area 67.

The thermal expansion of the pressure roller 160 is probably a combination of the thermal expansion of the elastic layer 66 itself and the thermal expansion of the gas in the air bubbles contained in the elastic layer 66. Since the release layer 68 is stacked on the outer circumference of the elastic layer 66, the gas in the air bubbles is unlikely to be released outwardly in the radial direction of the elastic layer 66, thus the pressure roller 160 is likely to expand.

Figure 5:
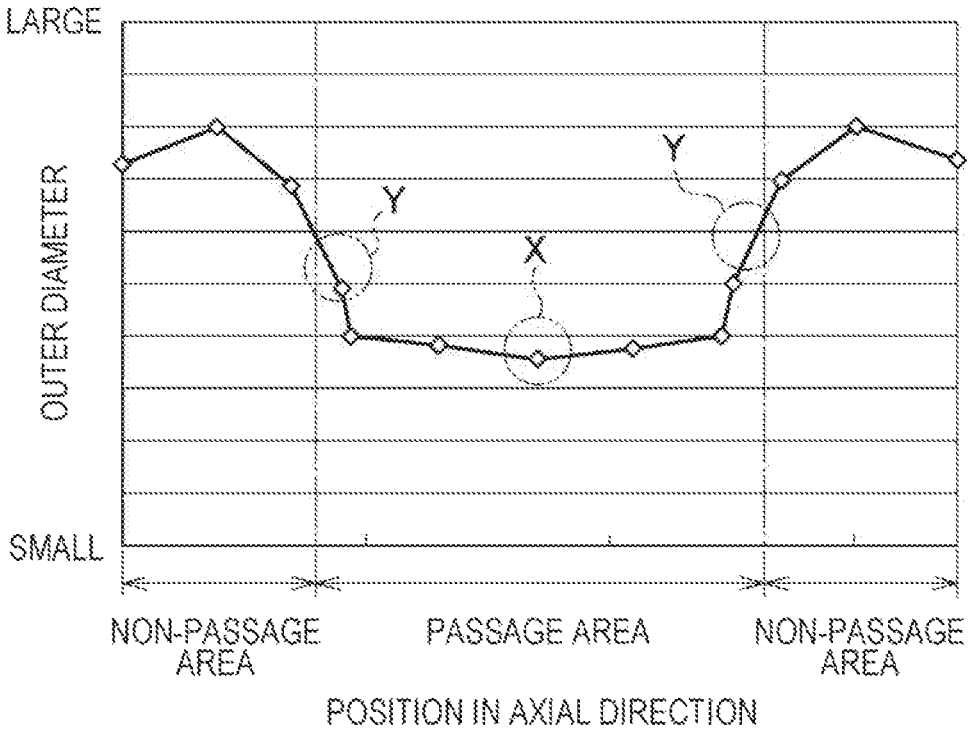
FIG. 5 PRIOR ART
FIG. 5 is a graph illustrating the relationship between a passage area through which a recording medium passes, a non-passage area through which a recording medium does not pass, and the outer diameter of the pressure roller thermally expanded.

As illustrated in FIG. 3, the contact area 67 has the passage area through which the recording medium P passes and the non-passage area through which the recording medium P does not pass. FIG. 5 illustrates the relationship between the passage area through which the recording medium passes, the non-passage area through which the recording medium does not pass, and the outer diameter of the pressure roller 160 thermally expanded. In the passage area, the heat of the heat fixing belt 70 and the pressure roller 160 is taken by the recording medium P, thus as illustrated in FIG. 5, the outer diameter of the pressure roller 160 increases in the both end-side portions (see a two-dot chain line Y) more than in the central-side portion (see a two-dot chain line X) of the passage area in the axial direction. Thus, when the heat fixing belt 70 and the pressure roller 160 transport the recording medium P inserted in the contact area 67, the pressure is increased at both ends of the recording medium P in the width direction, and uneven fixing (uneven gloss) and/or wrinkles of the recording medium P may occur.

In contrast, in the exemplary embodiment, as illustrated in FIG. 3, in the cylindrical sleeve 64 on which the elastic layer 66 is stacked, axial both-end side portions relative to the central portion in the axial direction are not constrained to the core metal 62. In other words, in the cylindrical sleeve 64, the axial both-end side portions relative to the central portion is extendable relative to the core metal 62.

Consequently, the elastic layer 66 is likely to expand (extend) in the axial direction of the core metal 62, and thus outward expansion in the radial direction of the core metal 62 is reduced. Therefore, increase in the outer diameter of the pressure roller 60 is reduced. As a consequence, the variation in the transport speed when the heat fixing belt 70 and the pressure roller 60 transport the recording medium P inserted in the contact area 67 is reduced.

Increase in the outer diameter of both-end side portions of the pressure roller 60 in the axial direction in the passage area is reduced. As a consequence, when the heat fixing belt 70 and the pressure roller 60 transport the recording medium P inserted in the contact area 67, increase in the pressure at both ends of the recording medium P in the width direction is reduced, and occurrence of uneven fixing (uneven gloss) and/or wrinkles of the recording medium P is reduced. Consequently, degradation of the quality of the image formed on the recording medium P is reduced.

In order to release the gas in the air bubbles of the elastic layer 66 in the pressure roller 160 of the first comparative example illustrated in FIG. 4, a pressure roller 260 (the second comparative example) (see FIG. 6) is provided in which multiple through holes 265, which penetrate the pressure roller 60 in the axial direction, are formed in the circumferential direction of the elastic layer 66. In the pressure roller 260, when the heat fixing belt 70 and the pressure roller 260 transport the recording medium P inserted in the contact area 67, the pressure decreases at the portion where the through holes 265 are present, thus uneven fixing (uneven gloss) may occur.

In contrast, in the exemplary embodiment, no through hole 265, which penetrates the pressure roller 60 in the axial direction, is formed in the elastic layer 66 of the pressure roller 60. Therefore, when the heat fixing belt 70 and the pressure roller 60 transport the recording medium P inserted in the contact area 67, partial decrease in the pressure is reduced, and occurrence of uneven fixing (uneven gloss) is reduced.

In the exemplary embodiment, the linear expansion coefficient of the cylindrical sleeve 64 in the axial direction is higher than the linear expansion coefficient of the core metal 62 in the axial direction. Therefore, the cylindrical sleeve 64 is likely to extend in the axial direction relative to the core metal 62. Thus, when the elastic layer 66 thermally expands, increase in the outer diameter of the pressure roller 60 is reduced, as compared with the configuration (a third comparative example) in which the linear expansion coefficient of the cylindrical sleeve 64 in the axial direction is lower than or equal to the linear expansion coefficient of the core metal 62 in the axial direction.

In the exemplary embodiment, the linear expansion coefficient of the cylindrical sleeve 64 in the circumferential direction is lower than the linear expansion coefficient of the cylindrical sleeve 64 in the axial direction. Therefore, the cylindrical sleeve 64 is unlikely to extend in the circumferential direction, and likely to extend in the axial direction. Thus, when the elastic layer 66 thermally expands, increase in the outer diameter of the pressure roller 60 is reduced, as compared with the configuration (a fourth comparative example) in which the linear expansion coefficient of the cylindrical sleeve 64 in the circumferential direction is the same as the linear expansion coefficient of the cylindrical sleeve 64 in the axial direction.

In the exemplary embodiment, the linear expansion coefficient of the cylindrical sleeve 64 in the circumferential direction is lower than the linear expansion coefficient of the core metal 62 in the axial direction. Therefore, the cylindrical sleeve 64 is unlikely to extend in the circumferential direction. Thus, when the elastic layer 66 thermally expands, increase in the outer diameter of the pressure roller 60 is reduced, as compared with the configuration (a fifth comparative example) in which the linear expansion coefficient of the cylindrical sleeve 64 in the circumferential direction is higher than or equal to the linear expansion coefficient of the core metal 62 in the axial direction.

In the cylindrical sleeve 64, the central portion in the axial direction is constrained to the core metal 62, and the axial both-end side portions relative to the central portion are not constrained to the core metal 62. Therefore, when the cylindrical sleeve 64 thermally expands, uneven extension of the cylindrical sleeve 64 to one side in the axial direction is reduced, as compared with the configuration (a sixth comparative example) in which one end of the cylindrical sleeve 64 in the axial direction is constrained to the core metal 62, and the other end-side portion relative to the one end is not constrained to the core metal 62.

(First Modification of Pressure Roller 60)

In the pressure roller 60 of the exemplary embodiment, the cylindrical sleeve 64 is formed of one component. However, without being limited to this, as illustrated in FIGS. 7 and 8, a pressure roller 601, in which the cylindrical sleeve 64 is formed of multiple components, may be used as the pressure roller.

Figure 7:
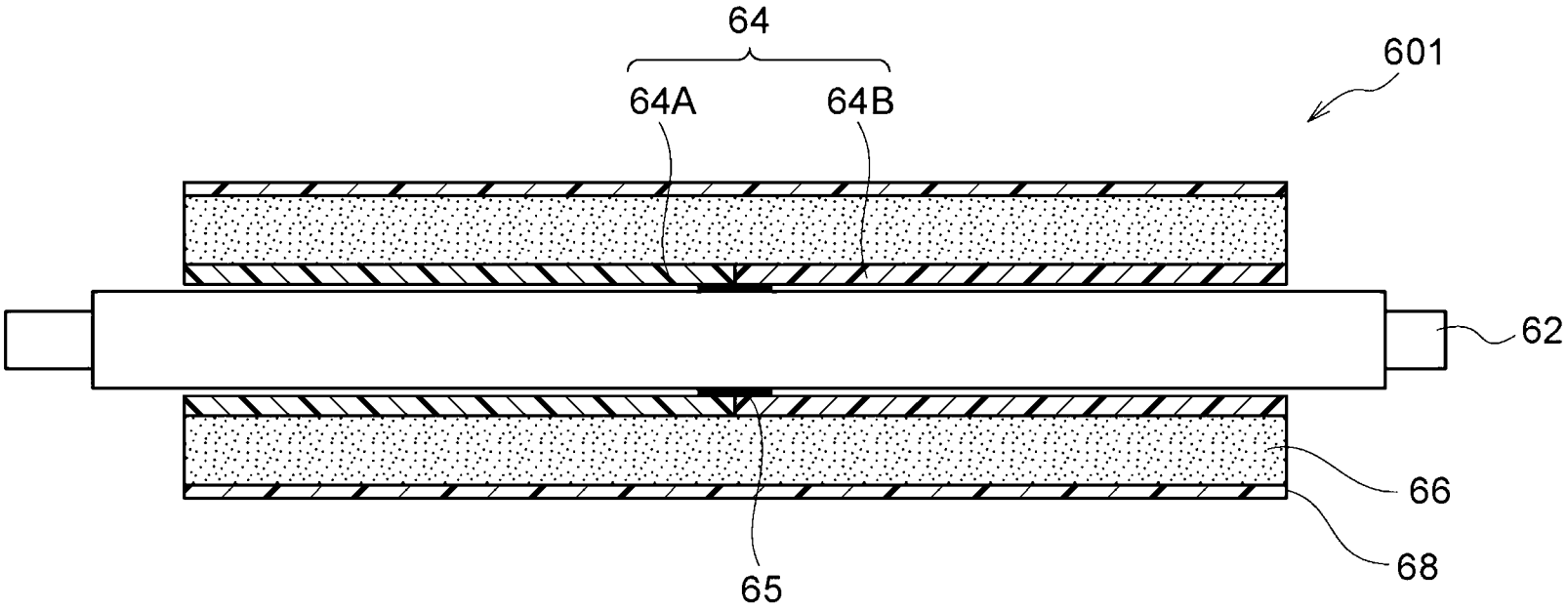
FIG. 7 is a cross-sectional view illustrating a first modification of a pressure roller according to the exemplary embodiment.
Figure 8:
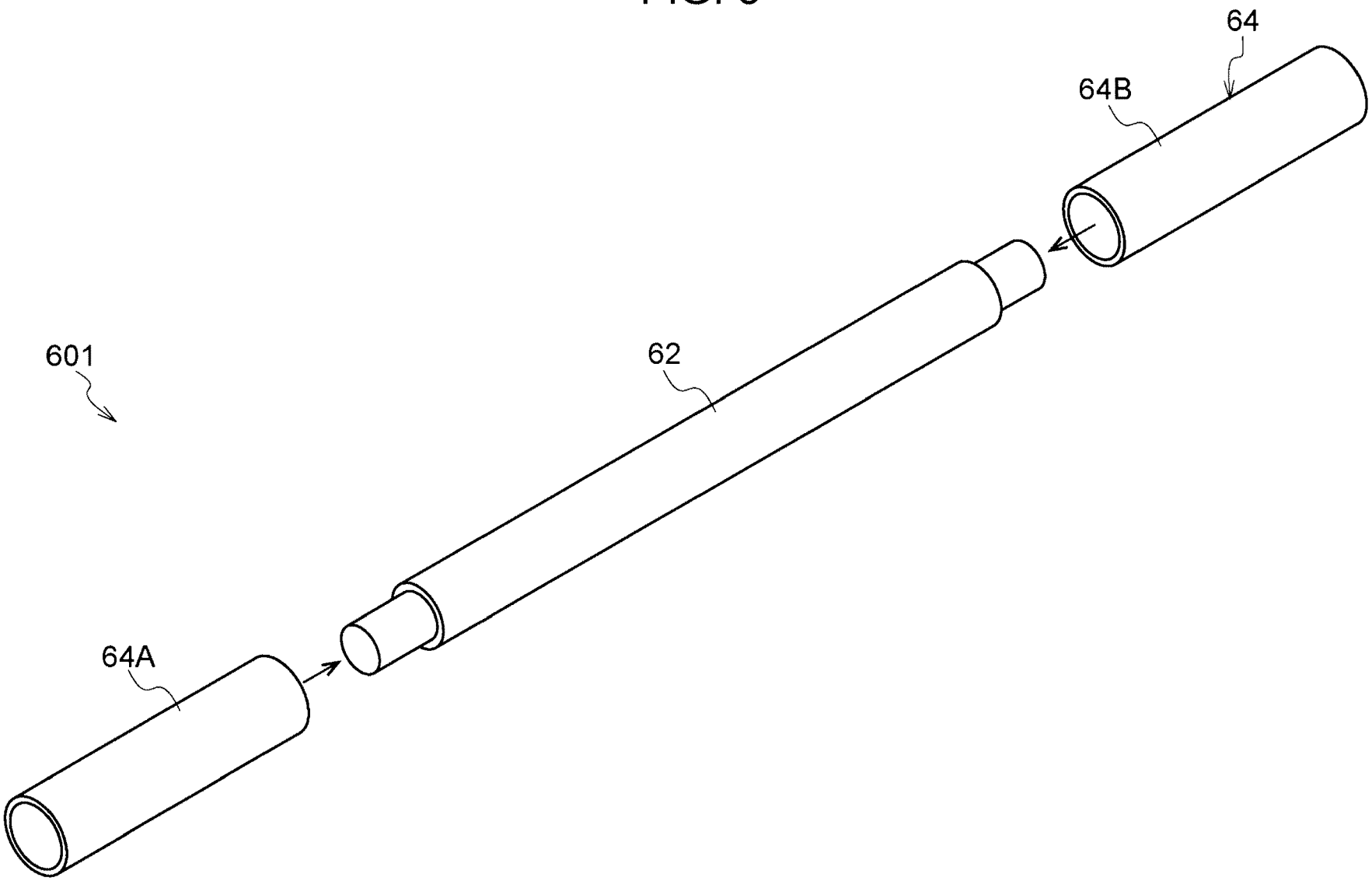
FIG. 8 is a perspective view illustrating the first modification of the pressure roller according to the exemplary embodiment.

The pressure roller 601 illustrated in FIGS. 7 and 8, has the cylindrical sleeve 64 including multiple components which are divided in the axial direction at the axial central portion constrained to the core metal 62.

Specifically, the cylindrical sleeve 64 has division sleeves 64A, 64B which are divided in the axial direction at the axial central portion constrained to the core metal 62. With this configuration, for instance, one end and the other end of the core metal 62 in the axial direction are covered with the division sleeves 64A, 64B, respectively, and the division sleeves 64A, 64B are fixed to the central portion of the core metal 62 in the axial direction by a fixing material 65 such as an adhesive.

In a configuration (a seventh comparative example) in which the cylindrical sleeve 64 is formed of one component, the central portion of the inner circumferential surface of the cylindrical sleeve 64 in the axial direction has to be fixed to the core metal 62 by the fixing material 65. Thus, in the seventh comparative example, for instance, after the fixing material 65 is applied to the central portion of the inner circumferential surface of the cylindrical sleeve 64 in the axial direction, the core metal 62 has to be inserted in and fixed to the cylindrical sleeve 64.

In contrast, in the pressure roller 601, when the division sleeves 64A, 64B are fixed to the central portion of the core metal 62 in the axial direction by the fixing material 65, the axial ends of the division sleeves 64A, 64B only have to be fixed to the core metal 62, and thus the cylindrical sleeve 64 is easily fixed to the core metal 62.

Therefore, in the pressure roller 601 illustrated in FIGS. 7 and 8, the central portion of the cylindrical sleeve 64 is constrained to the core metal 62 using a simple structure, as compared the configuration of the seventh comparative example.

(Second Modification of Pressure Roller 60)

Figure 9:
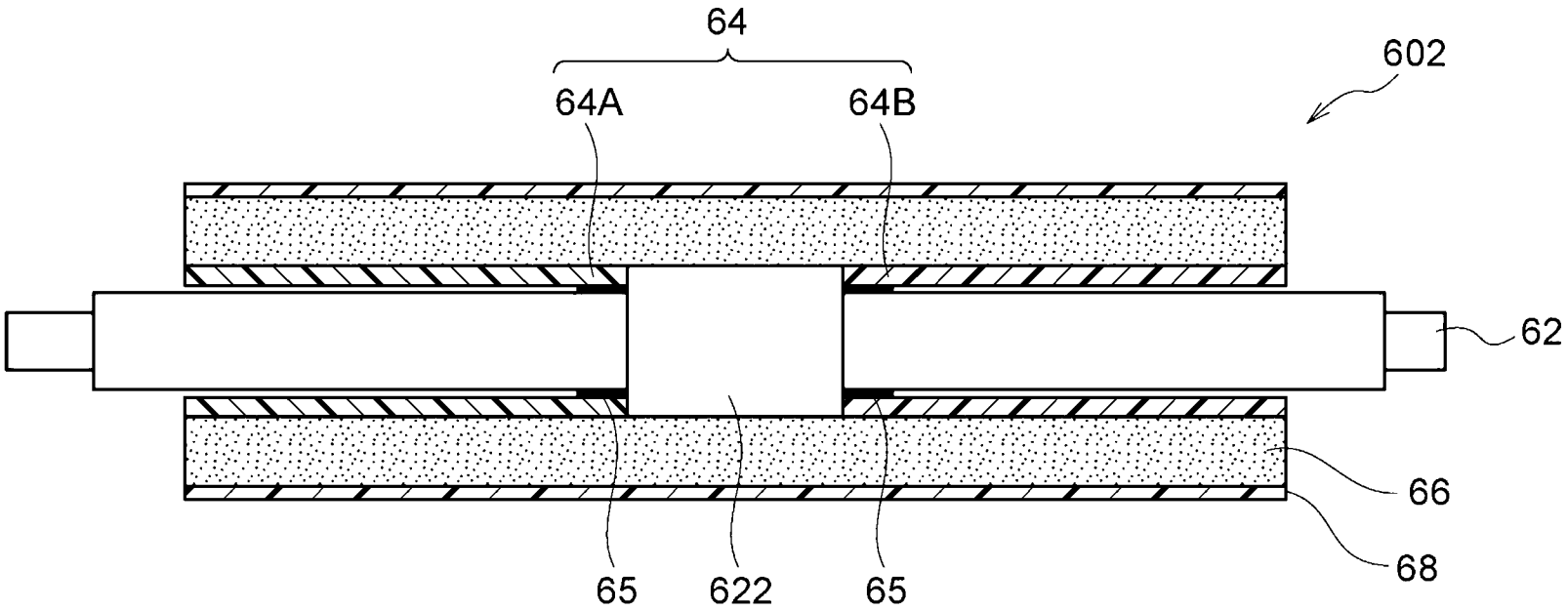
FIG. 9 is a cross-sectional view illustrating a second modification of the pressure roller according to the exemplary embodiment.

A pressure roller 602 illustrated in FIG. 9 may be used as the pressure roller in which the cylindrical sleeve 64 is divided into multiple components.

As illustrated in FIG. 9, the pressure roller 602 includes a large diameter section 622 which is formed at the central portion of the core metal 62 in the axial direction has a larger diameter than the diameter of the axial both-end side portions relative to the central portion in the axial direction. In the cylindrical sleeve 64, the axial ends of the division sleeves 64A, 64B are fixed to the end faces on the axial both-end sides of the large diameter section 622 by the fixing material 65 such as an adhesive.

Since the axial ends of the division sleeves 64A, 64B are fixed to the end faces on the axial both-end sides of the large diameter section 622 by the fixing material 65, the central portion of the cylindrical sleeve 64 in the axial direction is fixed to the core metal 62 using a simple structure, as compared with the configuration (an eighth comparative example) in which the inner circumferential surface of the cylindrical sleeve 64 is fixed to the outer circumferential surface of the core metal 62.

(Other Modifications)

In the exemplary embodiment, in the cylindrical sleeve 64, the central portion in the axial direction is constrained to the core metal 62, and the axial both-end side portions relative to the central portion are not constrained to the core metal 62. However, without being limited to this, for instance, a configuration may be adopted in which one end of the cylindrical sleeve 64 in the axial direction is constrained to the core metal 62, and the other end-side portion relative to the one end is not constrained to the core metal 62.

In the exemplary embodiment, the linear expansion coefficient of the cylindrical sleeve 64 in the circumferential direction is lower than the linear expansion coefficient of the cylindrical sleeve 64 in the axial direction. However, without being limited to this, for instance, the linear expansion coefficient of the cylindrical sleeve 64 in the circumferential direction and the linear expansion coefficient of the cylindrical sleeve 64 in the axial direction may substantially match in a predetermined acceptable range.

In the exemplary embodiment, the linear expansion coefficient of the cylindrical sleeve 64 in the circumferential direction is lower than the linear expansion coefficient of the core metal 62 in the axial direction. However, without being limited to this, for instance, the linear expansion coefficient of the cylindrical sleeve 64 in the circumferential direction and the linear expansion coefficient of the core metal 62 in the axial direction may substantially match in a predetermined acceptable range.

In the exemplary embodiment, the cylindrical sleeve 64 is fixed to the core metal 62 by the fixing material 65 such as an adhesive. However, without being limited to this, for instance, a configuration may be adopted in which a protruded section is formed in one of the inner circumferential surface of the cylindrical sleeve 64 and the outer circumferential surface of the core metal 62, and a recessed section is formed in the other circumferential surface, and the protruded section and the recessed section are fitted to each other. In this configuration, the cylindrical sleeve 64 is constrained to the core metal 62 in the portion in where the protruded section or the recessed section are formed, and is not constrained to the core metal 62 in other portions. In this configuration, due to the fitting of the protruded section to the recessed section, the cylindrical sleeve 64 rotates following the rotation of the core metal 62. Thus, it is sufficient that the cylindrical sleeve 64 have a function of rotating following the rotation of the core metal 62.

In the exemplary embodiment, the magnetic field generator 80 is used as an example of the heating device. However, without being limited to this, for instance, a sheet heating element, which comes into contact with the heat fixing belt 70 to heat the heat fixing belt 70, may be used as an example of the heating device. In the sheet heating element, for instance, a current flows through a heat generation layer included in the sheet heating element, and thus Joule heat is generated due to an internal resistance of the heat generation layer to cause heat generation.

In the exemplary embodiment, the heat fixing belt 70 is used as an example of the fixing member. However, without being limited to this, for instance, a fixing roller may be used as an example of the fixing member. In this case, as an example of the heating device, for instance, a heat source, such as a halogen lamp, disposed on the inner circumference side of the fixing roller is used.

The present disclosure is not limited to the exemplary embodiment described above, and various modifications, changes, improvements are possible within a range not departing from the spirit of the present disclosure. For instance, in the modifications described above, multiple modifications may be combined as appropriate.

(Evaluation Test)

The following tests are conducted to check the effect of the pressure roller 60 according to the exemplary embodiment.

Test Example 1

In Test Example 1, a test is conducted to examine change in the outer diameter of the pressure roller due to thermal expansion. In Test Example 1, comparison is made between the pressure roller 60 according to the exemplary embodiment (see FIGS. 2 and 3), the pressure roller 160 (see FIG. 4) according to the first comparative example, and the pressure roller 260 (see FIG. 6) according to the second comparative example. The peripheral velocity of each pressure roller is set 115 mm/s. The surface temperature of the central portion of the pressure roller in the axial direction is controlled by a small-diameter external heating roller which comes into contact with the pressure roller and rotates so that the surface temperature becomes 75° C., 125° C. 175° C. by changing the normal temperature (25° C.) and the surface temperature of the heat fixing belt 70, and when the outer diameter expansion is stabilized, the amount of increase in the outer diameter of the central portion of the pressure roller in the axial direction is measured. The amount of increase in the outer diameter of the central portion of the pressure roller in the axial direction is measured by the laser outer diameter measurement device (LS-9000 manufactured by Keyence).

Figure 10:
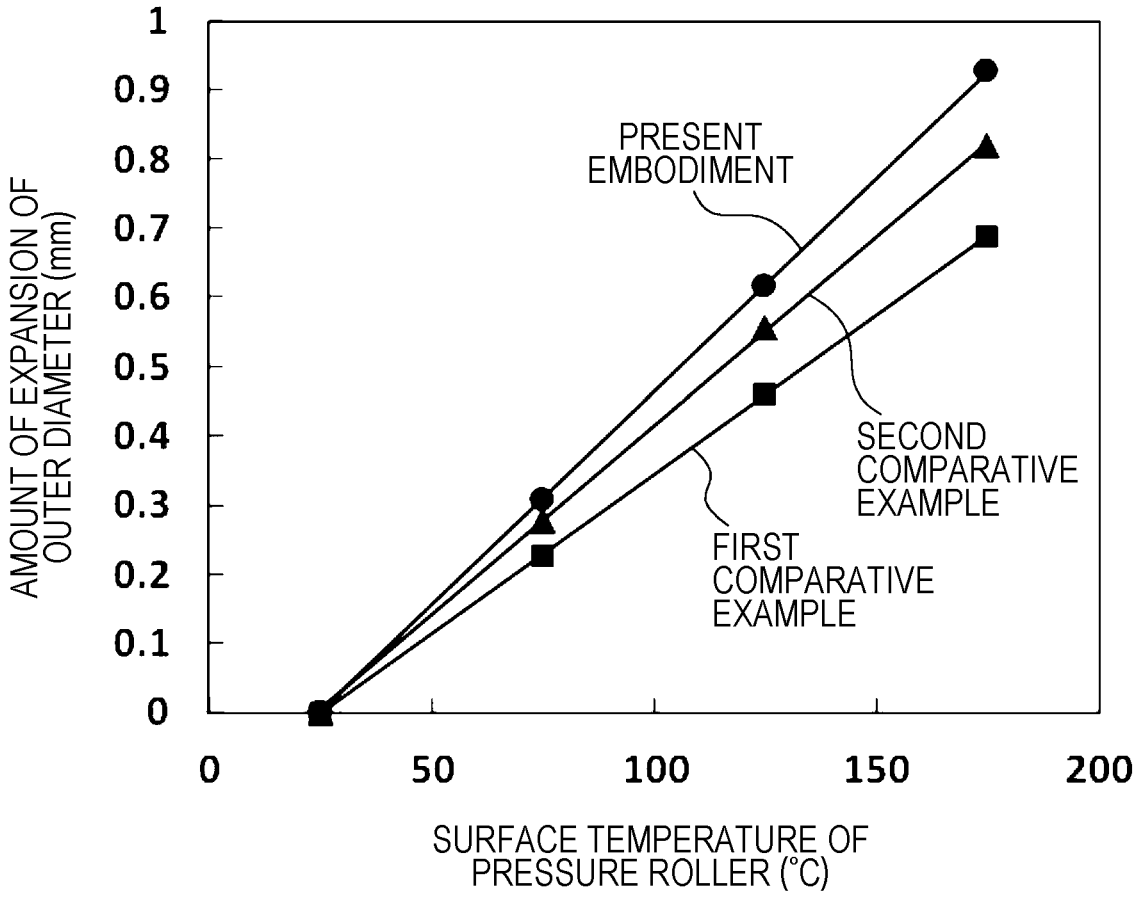
FIG. 10 is a graph illustrating a result of Test Example 1.

FIG. 10 is a graph illustrating a distribution of the amount of increase in the outer diameter of the central portion of the three types of pressure rollers in the axial direction. According to FIG. 10, it has been verified that the outer diameter expansion is maintained at a low level in the pressure roller 60 according to the exemplary embodiment, as compared with the first comparative example and the second comparative example.

Next, when paper is actually transported and a temperature difference is given to the surface of each of the three types of pressure rollers, an expansion level difference between the passage area and the non-passage area due to outer diameter expansion is measured. The peripheral velocity of each pressure roller is set 115 mm/s. B5 size paper having a basis weight of approximately 105 g/m$^2$ is used, the transport direction is set to the long side direction, and control is performed so that the temperature of the passage area on the surface of the heat fixing belt 70 is 160° C. 600 sheets of the paper are passed continuously at a rate 20 sheets/min, the amount of increase in the radius of each pressure roller is measured at multiple locations in the axial direction, and the level difference between the radii of the passage area and the non-passage area is determined. The amount of increase in the radius of each pressure roller is measured by multiple laser displacement meters (LK-G85 manufactured by Keyence) disposed in parallel to the center line of the rotational axis of the pressure roller.

As a result, the amount of increase in the radius of each pressure roller is 206 μm for the pressure roller 60 according to the exemplary embodiment, 277 μm for the pressure roller 160 according to the first comparative example, and 250 μm for the pressure roller 260 according to the second comparative example. Consequently, it has been verified that the pressure roller 60 according to the exemplary embodiment is capable of maintaining the level difference between the passage area and the non-passage area at a low level.

Test Example 2

Figure 6:
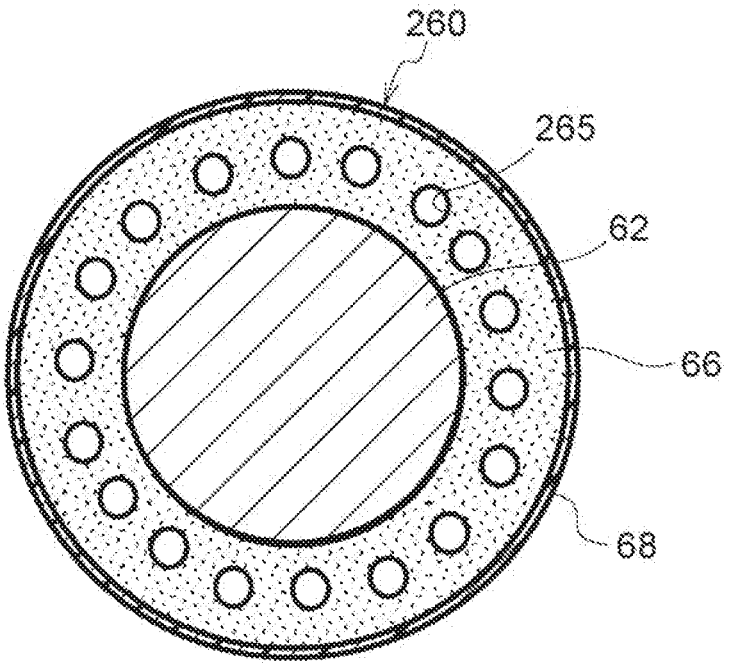
FIG. 6 PRIOR ART
FIG. 6 is a cross-sectional view of a pressure roller according to a second comparative example.

In Test Example 2, a test is conducted to examine the presence of occurrence of uneven gloss in the pressure roller 60 according to the exemplary embodiment (see FIGS. 2 and 3) and the pressure roller 260 according to the second comparative example (see FIG. 6). The through holes 265 of the pressure roller 260 according to the second comparative example each have a circular shape with a diameter of 1 mm at a normal temperature, and are provided at regular intervals in the circumferential direction at 18 positions each 2.5 mm away from the surface of the pressure roller 260 toward the center of the core metal 62.

An image filled with toner at a concentration of 10 g/m$^2$ is fixed by the fixing device on which the pressure roller 60 according to the exemplary embodiment is mounted and the fixing device on which the pressure roller 260 according to the second comparative example is mounted, at a peripheral velocity of 80 mm/s of each pressure roller. The both ends of the pressure roller in the axial direction are pressed against the heat fixing belt 70 by a load of 60 kgf.

As a result, when the pressure roller 160 according to the second comparative example is used, visually recognizable streaks of uneven gloss occur in an image, which correspond to the through holes 265 of the elastic layer 66. In contrast, when the pressure roller 60 according to the exemplary embodiment is used, uneven gloss at a visually recognizable level does not occur.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A pressing member for fixing, comprising:

an axial section;

a cylindrical body that includes the axial section internally inserted, rotates following rotation of the axial section, and is extendable in an axial direction relative to the axial section; and an elastic layer that is stacked on an outer circumference of the cylindrical body, wherein a linear expansion coefficient of the cylindrical body in the axial direction is within the range $3\times10^{-5}$/K to $2\times10^{-4}$/K, inclusive.

2. The pressing member for fixing according to claim 1, wherein a central portion of the cylindrical body in the axial direction is constrained to the axial section, and both-end side portions relative to the central portion in the axial direction are not constrained to the axial section.

3. The pressing member for fixing according to claim 2, wherein the cylindrical body includes a plurality of components that are divided at the central portion in the axial direction.

4. The pressing member for fixing according to claim 3, further comprising a large-diameter section that is formed at a central portion of the axial section in the axial direction, and has a diameter larger than a diameter at both-end side portions relative to the central portion in the axial direction, wherein ends of the plurality of components in the axial direction disposed on both-end sides of the large-diameter section in the axial direction are fixed to end faces of the both-end sides of the large-diameter section in the axial direction.

5. A fixing device comprising:

the pressing member for fixing according to claim 1, a heating device; and a fixing member that is heated by the heating device, pressed by the pressing member for fixing to form a contact area between the pressing member for fixing and the fixing member, transports a recording medium inserted in the contact area, and heats and pressurizes an image to fix the image onto the recording medium.

6. The fixing device according to claim 5, wherein the contact area includes a passage area in which the recording medium passes on a central side in the axial direction, and a non-passage area in which the recording medium does not pass on both-end sides relative to the passage area in the axial direction.

7. An image forming apparatus comprising:

a former that forms an image on a recording medium;

the fixing device according to claim 5; and a transport device that transports the recording medium, on which the image is formed, to a contact area between the fixing member and the pressing member for fixing.

8. The pressing member for fixing according to claim 1, wherein a ratio of a cylindrical body thickness to the linear expansion coefficient ranges from $1\times10^4$–$1.6\times10^4$ (K-mm).

9. A pressing member for fixing, comprising:

an axial section;

a cylindrical body that includes the axial section internally inserted, wherein part of the cylindrical body in an axial direction is constrained to the axial section, and one end portion relative the part in the axial direction is not constrained to the axial section; and an elastic layer that is stacked on an outer circumference of the cylindrical body, wherein a linear expansion coefficient of the cylindrical body in the axial direction is within the range $3\times10^{-5}$/K to $2\times10^{-4}$/K, inclusive.

10. A pressing member for fixing, comprising:

an axial section;

a cylindrical body that includes the axial section internally inserted, rotates following rotation of the axial section, and is extendable in an axial direction relative to the axial section; and an elastic layer that is stacked on an outer circumference of the cylindrical body, wherein a linear expansion coefficient of the cylindrical body in the axial direction is higher than a linear expansion coefficient of the axial section in the axial direction.

11. The pressing member for fixing according to claim 10, wherein a linear expansion coefficient of the cylindrical body in the axial direction is within the range $3\times10^{-5}$/K to $2\times10^{-4}$/K, inclusive.

12. The pressing member for fixing according to claim 10, wherein a ratio of a cylindrical body thickness to the linear expansion coefficient ranges from $1\times10^{4}$-$1.6\times10^{4}$ (K-mm).

13. A pressing member for fixing, comprising:

an axial section;

a cylindrical body that includes the axial section internally inserted, rotates following rotation of the axial section, and is extendable in an axial direction relative to the axial section; and an elastic layer that is stacked on an outer circumference of the cylindrical body, wherein a linear expansion coefficient of the cylindrical body in a circumferential direction is lower than a linear expansion coefficient of the cylindrical body in the axial direction.

14. The pressing member for fixing according to claim 13, wherein the linear expansion coefficient of the cylindrical body in the circumferential direction is lower than a linear expansion coefficient of the axial section in the axial direction.

15. The pressing member for fixing according to claim 13, wherein a linear expansion coefficient of the cylindrical body in the axial direction is within the range $3\times10^{-5}$/K to $2\times10^{-4}$/K, inclusive.

16. The pressing member for fixing according to claim 13, wherein a ratio of a cylindrical body thickness to the linear expansion coefficient ranges from $1\times10^{4}$-$1.6\times10^{4}$ (K-mm).

* * * * *